US006899610B2

(12) United States Patent
Cooper et al.

(10) Patent No.: US 6,899,610 B2
(45) Date of Patent: May 31, 2005

(54) RETAINING RING WITH WEAR PAD FOR USE IN CHEMICAL MECHANICAL PLANARIZATION

(75) Inventors: Richard D. Cooper, Sullivan, IN (US); Paul Fathauer, Sullivan, IN (US); Angela Mroczek-Petroski, Crawfordsville, IN (US); David Perry, Crawfordsville, IN (US); James P. Macey, Crawfordsville, IN (US)

(73) Assignee: Raytech Innovative Solutions, Inc., Sullivan, IN (US)

( * ) Notice: Subject to any disclaimer, the term of this patent is extended or adjusted under 35 U.S.C. 154(b) by 134 days.

(21) Appl. No.: 10/156,655

(22) Filed: May 28, 2002

(65) Prior Publication Data

US 2002/0182994 A1 Dec. 5, 2002

Related U.S. Application Data

(60) Provisional application No. 60/295,472, filed on Jun. 1, 2001.

(51) Int. Cl.[7] ..... B24B 5/00

(52) U.S. Cl. ..... 451/397; 451/287; 451/398

(58) Field of Search ..... 451/397, 41, 285–289, 451/28, 398, 532, 296

(56) References Cited

U.S. PATENT DOCUMENTS 6,171,513 B1 1/2001 Davis et al. ..... 216/88
6,179,694 B1 * 1/2001 Quek ..... 451/286
6,251,215 B1 * 6/2001 Zuniga et al. ..... 156/345.12
6,277,008 B1 8/2001 Masuta et al. ..... 451/286
6,390,904 B1 * 5/2002 Gleason et al. ..... 451/286
6,533,645 B2 * 3/2003 Tolles ..... 451/41
6,602,114 B1 * 8/2003 Wang et al. ..... 451/41
6,607,428 B2 * 8/2003 Tolles ..... 451/286

* cited by examiner

*Primary Examiner*—Lee D. Wilson
(74) *Attorney, Agent, or Firm*—Much Shelist Freed

(57) ABSTRACT

A novel retaining ring having a wear pad of such construction, design and material such that it provides improved resistance to wear and/or degradation as compared to currently available products for use in the chemical mechanical planarization (CMP) of semiconductor wafers and similar materials. The retaining ring with wear pad of the invention is able to withstand increased operating temperatures and pressures at the polishing surface of the wafer with less wear than would normally be encountered with currently used materials and designs. The ability to operate at increased temperature and pressure can accelerate the rate of removal of material from a semiconductor wafer in some processes. The flexibility of a manufacturer to use an expanded range of temperature and pressure in CMP processes, combined with a significant reduction in the cost of consumables, provides a significant advantage in the final cost of ownership in the production of multilayer, integrated circuit devices and other products where CMP is utilized in manufacture. Moreover, the retaining with wear pad of the present invention may also retrofitted to previously used and worn retaining rings of the prior-art design, thus salvaging the major structural component of the CMP processing apparatus, thereby reducing costs. It is also an integral part of this invention to make the consumable component of the new design replaceable, so as to make replacement of this part less costly when such replacement finally does become necessary.

40 Claims, 7 Drawing Sheets

RETAINING RING WITH WEAR PAD FOR USE IN CHEMICAL MECHANICAL PLANARIZATION

CROSS REFERENCE TO RELATED APPLICATION

Priority of provisional application Ser. No. 60/295,472, filed on Jun. 1, 2001, is hereby claimed.

BACKGROUND OF THE INVENTION

Enabling technology for the manufacture of multiple layer integrated circuit devices has been chemical mechanical planarization (CMP). In this process, each layer of wiring devices or of insulating material is polished flat (planarized) prior to deposition of the next layer. CMP facilitates the construction of multi-layer integrated circuit devices by reducing irregularities in surface topography to an acceptable level, to thus prevent defects such as short circuits or open circuits as the layers are built up.

The machinery to perform CMP has become highly sophisticated and efficient, with equipment costing millions of dollars. Nevertheless, there are some components of this equipment that require frequent replacement during the polishing operation, and are classed as consumables. These parts contribute significantly to the high costs of CMP equipment operation. One of these short-lived, consumable components is the retaining ring, which is part of the polishing head assembly (alternatively called the wafer carrier). The retaining ring serves to hold the semiconductor wafer and keep it in place during the polishing operation where it is forced against the polishing pad. The retaining ring conventionally consists of a stainless steel body to which a non-metallic wear member is attached. The non-metallic wear member surrounds the wafer, while the bottom surface of the wear member contacts the polishing pad directly. A flexible diaphragm within the polishing head above the wafer applies downward pressure on the wafer. Thus, the wafer is entrapped in a cavity created by the retaining ring assembly, the polishing pad below, and the flexible diaphragm above. Downward pressure on the retaining ring is applied independently of the flexible diaphragm, and can be varied in order to prevent the wafer from forcing its way out and being destroyed. The non-metallic part of the retaining ring is the only part that is in contact with the polishing pad in addition to the wafer. As such, it is subject to the polishing action of the polishing pad and the abrasive slurry.

Current retaining ring construction materials, although having other desirable properties, do not have good wear resistance. The average life of presently available retaining rings is approximately 500 wafers under normal circumstances. At increased temperature and pressure, this will be significantly lower. Replacement of the retaining ring on a regular basis adds substantially to the cost of ownership of the CMP process machinery. Under current practice, the entire retaining ring assembly is generally discarded and replaced with a new one. It would, therefore, be highly desirable to develop a retaining ring with increased useful life, with the capability of operating at increased temperatures and pressures, and which has the capacity of replacing only its wear-surfaces. One prior-art retaining ring currently available is manufactured of polyphenylene sulfide (PPS). This material seems satisfactory in most regards, but requires frequent replacement as the material wears. The typical lifetime of current designs is about 500 wafers.

In commonly-owned, copending application Ser. No. 10/087,223, filed on Mar. 1, 2002, which application is incorporated by reference herein, there is disclosed a polishing pad made of fibrous construction, which may include various natural or synthetic fillers, abrasives or friction modifiers, the whole matrix being bound together by a thermosetting resin, densified, and heat cured under pressure to produce a rigid, yet porous, structure. One or both surfaces of the polishing pad of the invention are ground, sanded, or the equivalent, to lift and expose fibers in a random, three-dimensional pattern that becomes the active polishing surface or surfaces. The basic fiber matrix may be any natural or synthetic fiber or blend thereof that is felted, dry laid, wet laid, woven, carded, spun, blown, or any other process that produces a porous fiber matrix that can be resin-impregnated and processed as above.

SUMMARY OF THE INVENTION

It is, therefore, the primary objective of the present invention to provide a retaining ring for use in retaining a wafer during polishing by a CMP apparatus, which has a wear pad associated therewith of such construction, design and material such that it provides improved resistance to wear and/or degradation as compared to currently available products for use in the chemical mechanical planarization (CMP) of semiconductor wafers and similar materials.

It is yet another objective of the present invention to provide such a retaining ring with a wear pad, which wear pad is made of comprised of fibrous material impregnated with a thermosetting resin.

It is yet another objective of the present invention to provide such a retaining ring with a wear pad, with an insulating layer being interposed between the wear pad and the bottom surface of the retaining ring, whereby heat generated during wafer-polishing is better retained in order to elevate the temperature at which wafer-polishing is performed.

It is yet another objective of the present invention to provide such a retaining ring with a wear pad, which wear pad has a bottom surface that may be either ground and/or provided with hard abrasive additive.

It is yet another objective of the present invention to provide a means of re-using retainer rings of the prior art by retrofitting them with the wear pad of the present invention.

The retaining ring with wear pad of the invention is able to withstand increased operating temperatures and pressures at the polishing surface of the wafer with less wear than would normally be encountered with currently used materials and designs. The ability to operate at increased temperature and pressure can improve the polishing removal rate in some processes such as tungsten, copper and oxide. The flexibility of a manufacturer to use an expanded range of temperature and pressure in CMP processes, combined with a significant reduction in the cost of consumables, provides a significant advantage in the final cost of ownership in the production of multilayer, integrated circuit devices and other products where CMP is utilized in manufacture. Moreover, the retaining-ring wear pad of the present invention may also retrofitted to previously used and worn retaining rings of the prior-art design, thus salvaging the major structural component of the CMP processing apparatus, thereby reducing costs. It is also an integral part of this invention to make the wear pad of the invention replaceable, so as to obviate the necessity of replacement of an entire retaining ring, resulting in considerable cost-savings.

BRIEF DESCRIPTION OF THE DRAWINGS

The invention will be more readily understood with reference to the accompanying drawings, wherein:

FIG. 6 is a cross section of a fifth embodiment of the retaining ring with wear pad for use in CMP processes, wherein the entire working surface of the retaining ring is the wear pad material of the invention, and where the wear pad serves both as the wear material and as the wafer retainer material, with the primary advantage being that the material can wear more than 0.010 thousandths of an inch before replacement and.

DETAILED DESCRIPTION OF THE INVENTION

Figure 1:
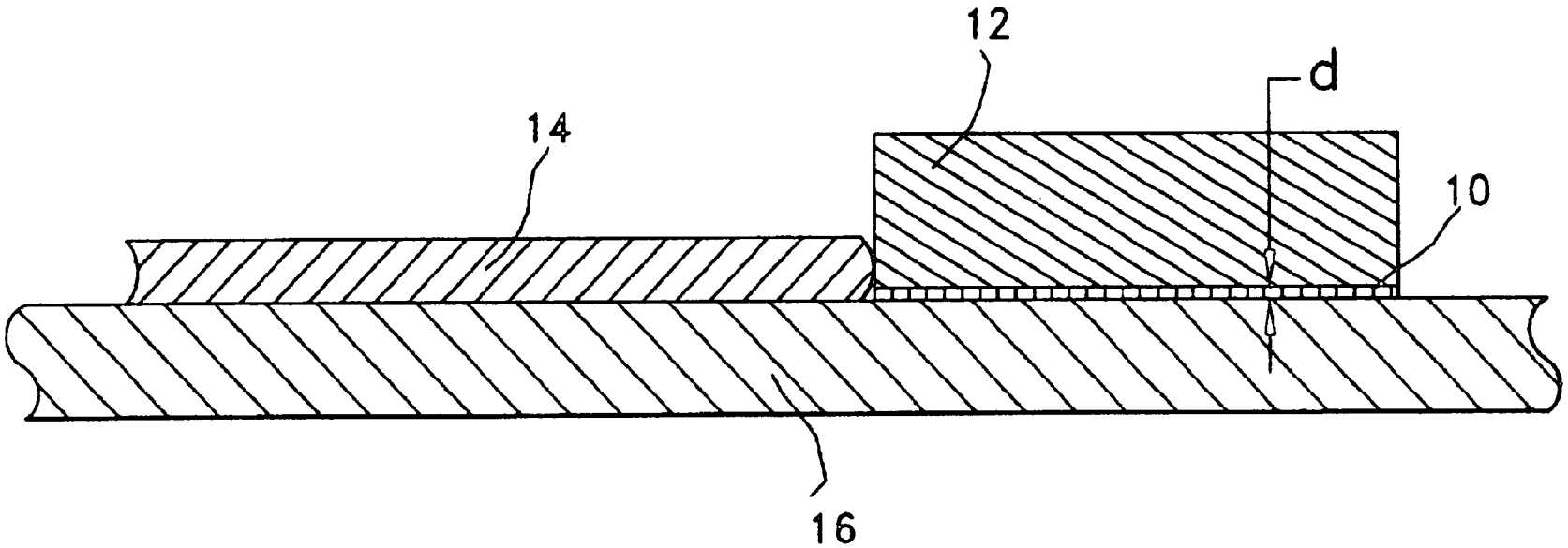
FIG. 1 is a cross section of a first embodiment of the retaining ring with wear pad for use in CMP processes, wherein a thin (0.010 of an inch or less) wear pad is adhesively attached to the bottom of a retaining ring that is constructed of a thermoplastic material, with the semiconductor wafer being shown abutting the inside diameter of the retaining ring, and with the bottom surfaces of the wafer and the wear pad being in contact with the polishing pad.

Referring to the drawings in greater detail, there is shown in FIG. 1 a cross section of the first embodiment of the annular retaining ring with wear pad for use in CMP processes, wherein a thin, 0.010 of an inch or less, annular wear pad 10 is adhesively attached to the bottom of annular retaining ring 12, which retaining ring is constructed of a thermoplastic material, such as PPS. A semiconductor wafer 14 to be polished by a polishing head of a CMP apparatus is shown abutting the inside annular surface of the retaining ring 12 and retained thereby. The bottom surface of the wafer 14 and the annular wear pad 10 are in contact with polishing pad 16 of a conventional polishing head assembly described hereinbelow with reference to FIG. 2. The embodiment of FIG. 1 significantly reduces retaining-ring wear by replacing about 0.010 inches or less at the contact surface of the retaining ring with about 0.010 inches or less of the thick wear pad 10 of material bonded to the PPS of the retaining ring. While the wear pad withstands the heat and abrasion from the polishing pad, the PPS absorbs the impact from the wafer.

While presently available retaining rings last on average about 500 wafers polished before being replaced, the retaining ring of the present invention lasts approximately 2,500 wafers polished, about 5 times as long. Additional savings result from the reduction in down time required to change out worn retaining rings. This is under normal conditions. Furthermore, it has been found that in some CMP processes, notably tungsten CMP, increased operating temperature and pressure increase the rate of removal of tungsten. Under these conditions, prior-art, retaining-ring life is reduced even further. Excessive wear of prior-art, retaining rings at elevated pressure and/or temperature also increases defects by adding to particulate contamination on the wafer. With the present invention, the savings in cost of ownership for longer life and reduced downtime is significant. Making the wear-pad section replaceable reduces this cost even further. With consideration to the potential performance increase, the savings may be dramatic.

The wear pad of the invention is constructed of a fibrous matrix that has been impregnated with a thermosetting resin and dried, densified and cured under heat and pressure to create a rigid semi-porous structure. The surface of the retaining-ring wear pad that contacts the polishing pad is ground or sanded, if desired, or may be left "as molded", depending on the frictional performance required for the intended use. In some cases, the densification process results in a non-porous structure.

The basic fiber matrix is preferably any natural or synthetic fiber or blend that is felted, wet-laid, dry-laid, carded, spun, blown, woven, or other process that produces a porous fibrous matrix that can be resin-impregnated and processed as described above. Various natural or synthetic fillers of a suitable nature may also be incorporated into the base structure as needed in order to obtain specific physical characteristics. The preferred resin impregnation is with a thermosetting resin, such as phenolic, epoxy, silicone, or the like, although certain high-temperature thermoplastic resins may also be used. In one example, the wear-pad material is a wet-laid cotton fiber matrix that has been densified to a desired density. This fiber matrix is then impregnated with a phenolic resin to desired resin content, dried, and cured under heat and pressure to a semi-porous state, with the wear pad having a ground surface. Hard, abrasive particles may be incorporated into the material of the wear pad of the invention in order to condition the polishing pad during the polishing process. This conditioning generally improves the performance of the polishing pad. Pad conditioning is conventionally accomplished by means of a separate conditioning pad of the CPM apparatus that periodically conditions the polishing pad. The abrasive-particle additive that may be used may be diamond, diamond dust, aluminum oxide, colloidal alumina, aluminum silicate, clay aluminum silicate, colloidal silica, amorphous silica, silicon carbide, zirconia-alumina, cubic boron nitride, boron carbide, celite, ceramics, garnet, emery, pumice, iron oxide, feldspar, cerium oxide, fused alumina or tripoli, or other conventional materials.

The wear pad of the present invention has the distinct advantage of allowing the use of wear-resistant and impactresistant fillers in the pad material in order to increase life. This has not been preferable in prior-art, conventional retaining rings, since such fillers would be released onto the surface of the polishing pad, thereby, causing defects on the wafers being polished. In the present invention, fillers, abrasives and the like are less likely to be released onto the polishing pad.

Reference is had to co pending application Ser. No. 10/087,223, filed on Mar. 1, 2002, which application is incorporated by reference herein, in which is disclosed a polishing pad made of fibrous construction, which may include various natural or synthetic fillers, abrasives or friction modifiers, the whole matrix being bound together by a thermosetting resin, densified, and heat cured under pressure to produce a rigid, yet porous, structure. One or both surfaces of the polishing pad of the invention are ground, sanded, or the equivalent, to lift and expose fibers in a random, three-dimensional pattern that becomes the active polishing surface or surfaces. The basic fiber matrix may be any natural or synthetic fiber or blend thereof that is felted, dry laid, wet laid, woven, carded, spun, blown, or any other process that produces a porous fiber matrix that can be resin-impregnated and processed as above the wear-pad material of the present invention is preferably made similarly to the polishing pad material of this copending application. In some uses, however, the density of the wear pad is greater than that of the polishing pad disclosed in said application Ser. No. 10/087,223.

The wear-pad material is a matrix of absorbent fibers, such as cellulose fiber, which may include cotton linters and wood pulp, such as hardwood and softwood, and which are impregnated with a thermoset resin, preferably phenolic, is densified, grooved, if desired, and cured to provide a rigid, yet porous structure. Other thermoset resins may be used, such as silicones, epoxies, blends thereof, and the like. The fibers that may be used are: natural or synthetic including cellulose, wood pulp, "ARAMID", rayon, linen, carbon, graphite, polyamide fiber, polymer fiber, lyocell fiber, engineered fibers, etc, and combinations thereof. The cross-sectional diameters of the fibers may be between 10 and 50 microns, with a preferred range of between 15–35 microns. The length is preferably in the range of between 0.4 and 1.3 mm., although it is to be understood that fiber-lengths somewhat shorter or longer may be used effectively. The fibrous matrix constitutes approximately 30–80% by weight of the wear-pad material. In one form, the wearing pad surface is ground to achieve a surface finish of 1–25 mm $R_a$. If well-known, hard, abrasive particles are added as fillers to the wear pad material, such may be in the range of between approximately 10–500 microns in diameter, depending upon the specific use and desired properties. The density of the wear-pad is preferably in the range of approximately in the range of 0.3 to 2.0 g/cm$^3$. The manufacture of the wear-pad material may be accomplished by any of those methods disclosed in above-mentioned co pending application Ser. No. 10/087,223. Application of the wear-pad surface to the bottom surface of a retaining ring may be accomplished by well-known methods, such as molding, etching, photolithography, and the like.

Figure 2:
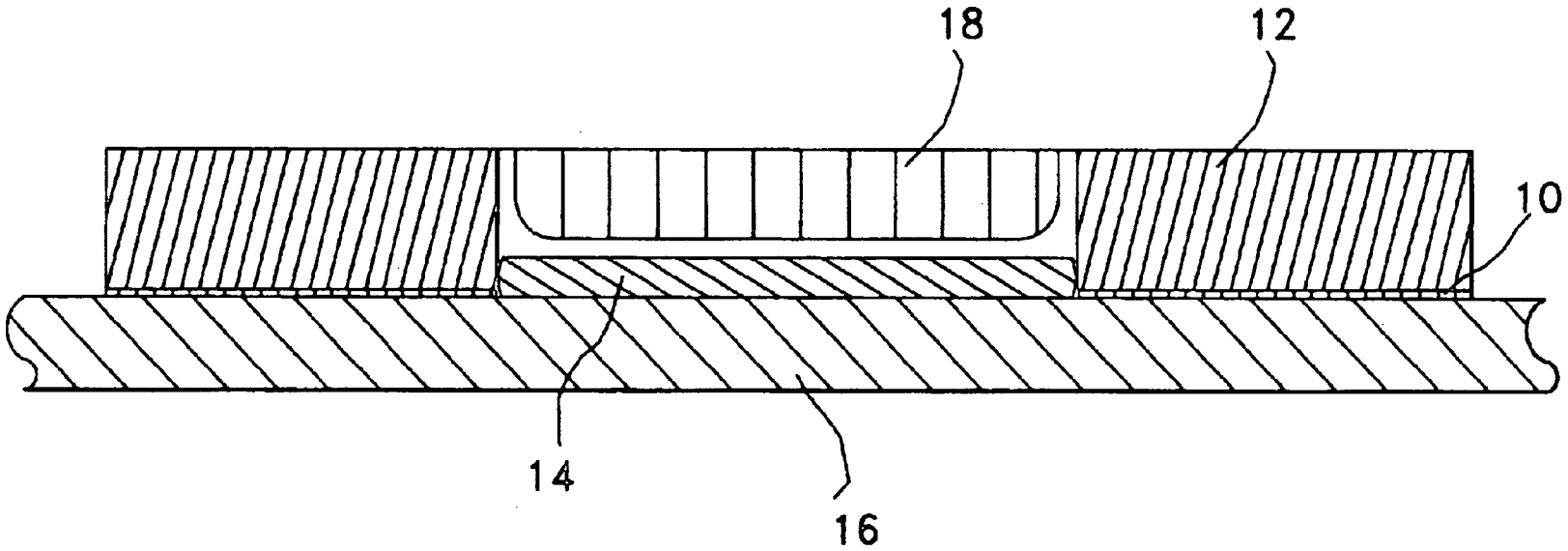
FIG. 2 is an enlarged cross sectional view of FIG. 1 showing a conventional polishing head with the retaining ring and wear pad, where separate diaphragms apply distinct downward pressures to the wafer and retainer ring assembly as the wafer is being polished.

FIG. 2 is a cross sectioned view of a typical polishing head (alternatively called a wafer carrier). The annular wear pad 10 is of the embodiment of FIG. 1, which is secured to the retaining ring body 12. The retaining ring secures wafer 14 to be polished by a polishing pad 16, against which wafer there is applied a downward pressure by means of a conventional flexible diaphragm 18. The retaining ring 12 and the flexible diaphragm 18 have separate and distinct pressure supplies that can be adjusted and controlled independently.

Figure 3:
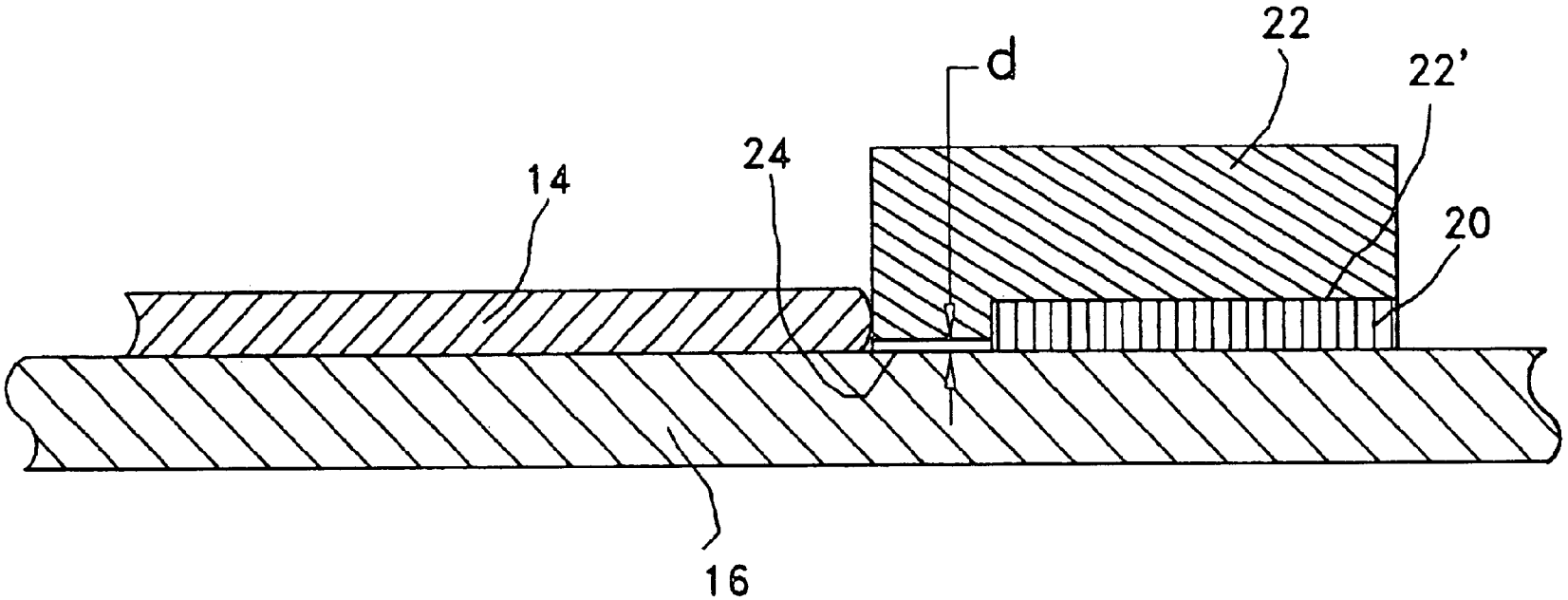
FIG. 3 is a cross section of a second embodiment of the retaining ring with wear pad for use in CMP processes, wherein the wear pad is inserted into the lower portion of the retaining ring such that the wear pad is in contact with the polishing pad, with the portion of the retaining ring contacting the wafer at its inside diameter being relieved at the bottom so as not to contact the polishing pad.

FIG. 3 is a cross section of a second embodiment, wherein a relatively thick annular wear pad 20 is inserted into a bottom, outer annular, cutout portion 22 of retaining ring 22, such that the wear pad 20 is in contact with the polishing pad 16. The portion of the retaining ring that contacts the wafer 14 at its interior annular surface has a relieved section 24 at its the bottom thereof, so that retaining ring proper does not contact the polishing pad 16. The relieved section 24 extends outwardly from the interior annular surface toward the exterior, or outer, annular surface of the retaining ring, such that it extends until reaching the interior annular surface of the wear pad 20. Preferably, but not required, the relieved section 24 has a depth "d", as measured from the top toward the bottom of the retaining ring, that is less than the depth, or height, of the wear pad 20, as seen in FIG. 3. The wear pad 20 protrudes about 0.010 inches or less beyond this relieved section 24, so that the retaining ring material never contacts the polishing pad. Thus, again, the wear pad withstands heat and abrasion from the polishing pad while the retaining ring.

Figure 4:
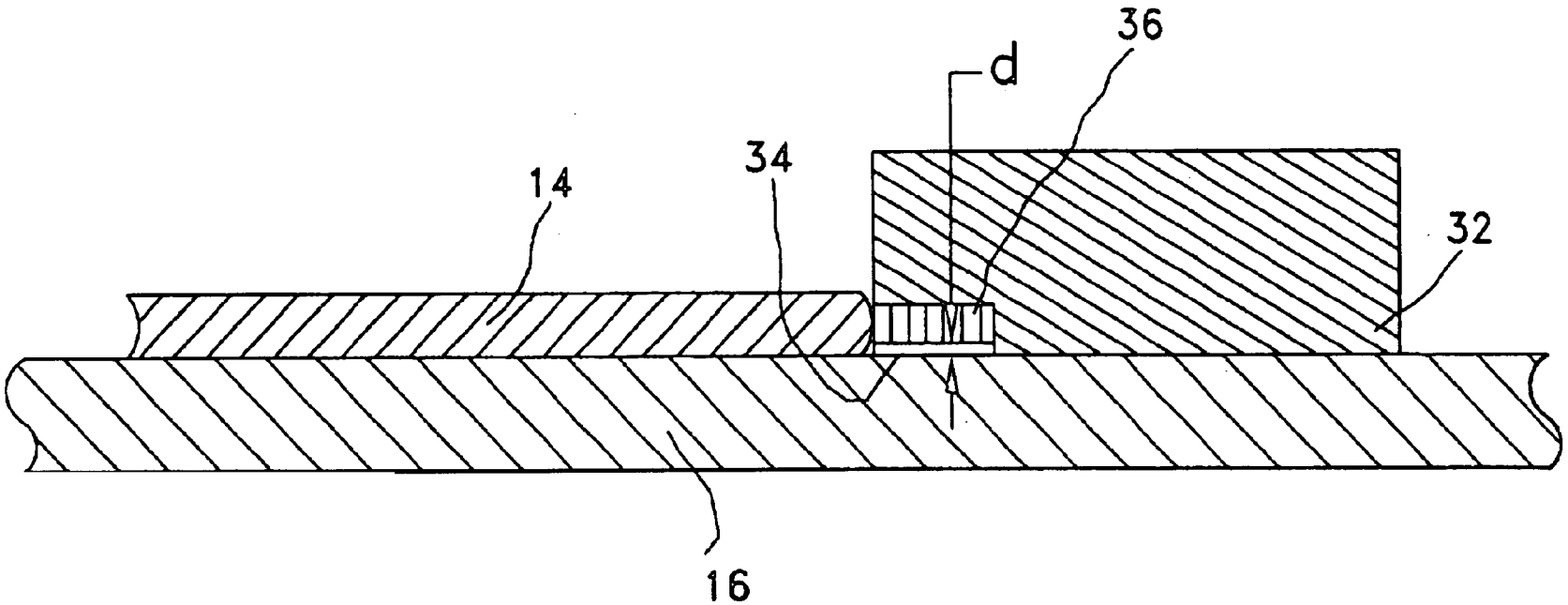
FIG. 4 is a cross section of a third embodiment of the retaining ring with wear pad for use in CMP processes, wherein the wear pad comprises the bulk, but not all, of the retaining ring, there being a small, ring-shaped section of suitable thermoplastic material is inserted into the lower inside diameter of the wear pad to act as a bumper against the wafer, with there being a gap between the thermoplastic material and the polishing pad, so that the thermoplastic ring does not contact the polishing pad.

FIG. 4 is a cross section of a third embodiment, wherein the annular retaining ring 32 is comprised of wear-pad material, thus effectively making the retaining ring 32 one large wear pad itself. The retaining ring 32 is formed with a bottom, interior annular cutout section or portion 34, in which is adhered, or otherwise formed, a relatively small, interior, annular or ring-shaped force-absorbing insert 36, of a suitable thermoplastic material, such as PPS, in order to act as a bumper against the wafer 14 during polishing. There is a gap "d" between the bottom surface of the annular, force-absorbing insert 36 and the bottom surface of the retaining ring, so that the force-absorbing ring 36 does not contact the polishing pad 16. The bottom surface of the annular retaining ring/wear pad combination protrudes preferably about 0.010 inches or less below the insert 36, so as to effectively provide a wear-pad section that resists the heat and abrasion of the polishing operation.

Figure 5:
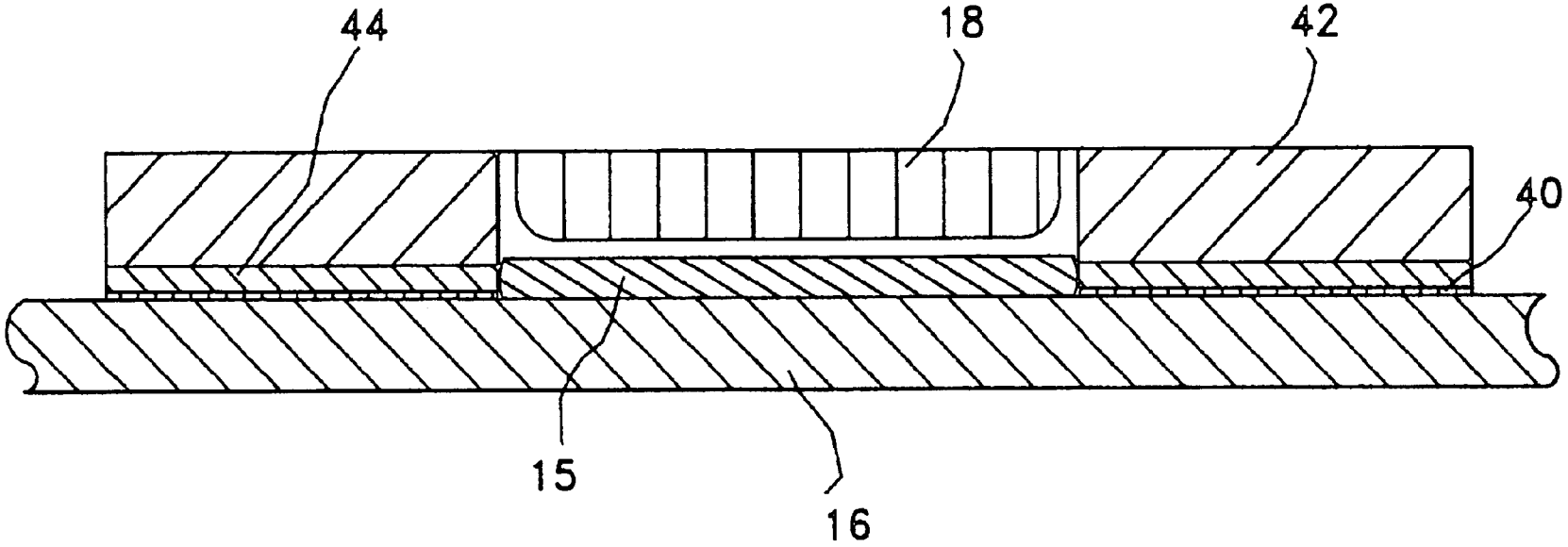
FIG. 5 is a cross section of a fourth embodiment of the retaining ring with wear pad for use in CMP processes, wherein a thin wear pad (0.010 thousandths of an inch or less) is adhesively attached to an insulating material that is adhesively attached to the retaining ring body, whereby as heat is generated at the interface of the semiconductor wafer and the polishing pad, the heat is retained by the wafer and polishing pad, thus increasing the interface temperature and thereby increasing the rate of removal in some CMP applications.

FIG. 5 is a cross section of a fourth embodiment, wherein a thin, annular wear pad 40 of approximately 0.010 thousandths of an inch or less is adhesively, or otherwise, attached, to an annular, insulating-material ring 44 that is itself adhesively, or otherwise, attached to the annular retaining ring 42. Heat generated at the interface of semiconductor wafer 15 and the polishing pad 16 is retained by the wafer and polishing pad by means of the annular, insulating-material ring 44, thus increasing the interface temperature and thereby increasing the rate of removal in some applications. The interior annular surface of the annular, insulating-material ring 44 itself contacts against the wafer 15 for securing the wafer during the CMP polishing process, to thus enhance heat-retention. Conversely, if a CMP operation were advantageously desired to be run in a cool state, this insulation effect would also serve to enhance performance.

Figure 6:
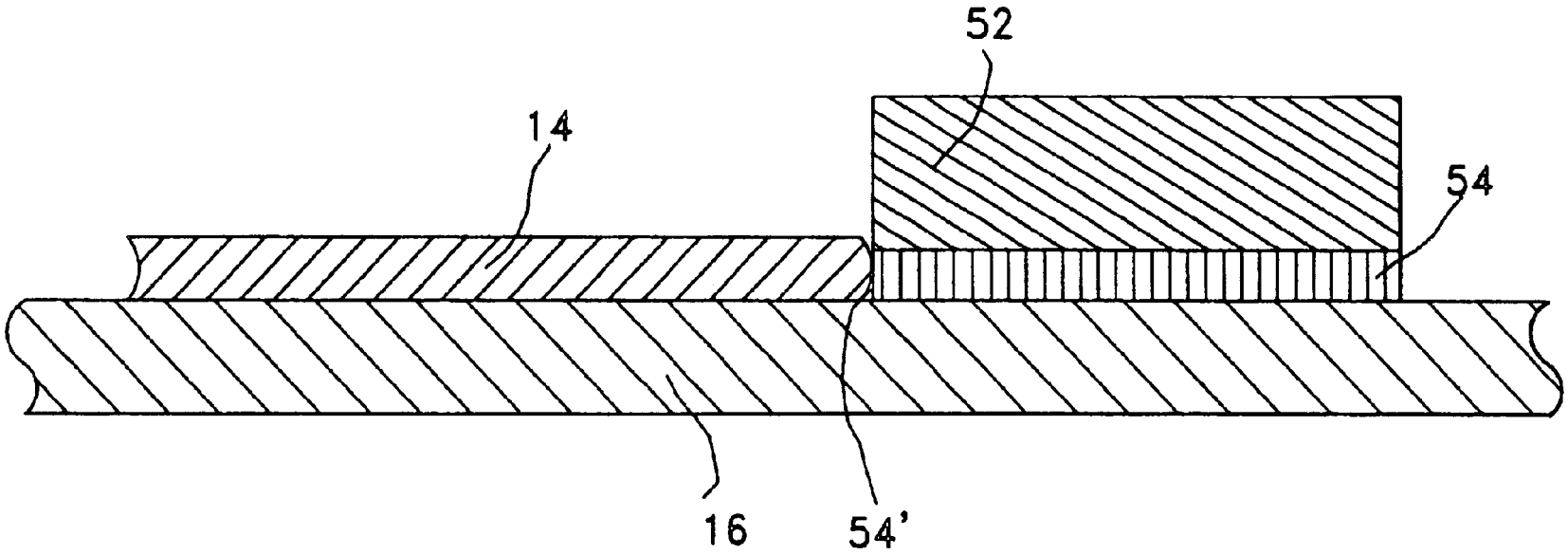

FIG. 6 is a cross section of a fifth embodiment, which is a combination of the embodiments of FIGS. 1 and 4, wherein the bottom and interior annular working surfaces of the retaining ring 52 is an annular retaining wear pad 54 of the invention. In this embodiment, the annular wear pad 54 acts as the bumper against the wafer 14 via its interior annular surface 54'. The remainder of the retaining ring is made of PPS, or the like, as in conventional retaining rings. The net effect of this embodiment is to replace the nonmetallic working component of a retaining ring with the novel wear-pad material of this invention in its entirety.

Figure 7A:
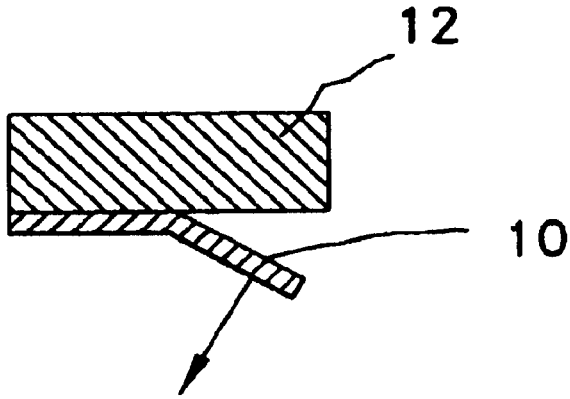
FIGS. 7A and 7B are cross sections similar to FIG. 1 and showing the replacement of the wear pad of FIG. 1, after it has become worn out, by peeling the worn one off and attaching another, new wear pad of the invention.
Figure 7B:
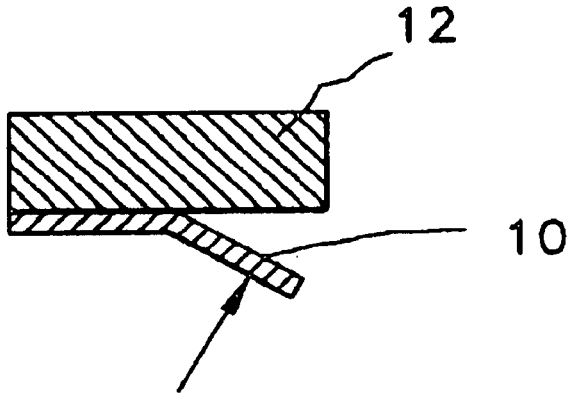

With respect to the capability of modifying or retrofitting existing prior-art retainer rings, any of the above-mentioned embodiments may be used. For the embodiment shown in FIG. 1, the thin wear pad may be adhesively or otherwise attached to used or new retaining rings. After the wear pad 10 of FIG. 1 has become worn, it may be removed and replaced with another, new wear pad 10 in the same manner as the worn one was applied. such as adhesively, by simply peeling off the old, worn pad 10, as seen in FIG. 7A, and replacing it with the new pad 10, as seen in FIG. 7B. In typical CMP apparatuses, a certain amount of retainer-ring wear is acceptable and compensated for by the machine. When the ring has been worn down, the wear pad may be attached. By doing so, the overall thickness may be returned to the operational range. Conversely, for a new retainer ring, depending on the overall thickness, the wear pad may be simply attached without modification or a small thickness of the working surface may be removed prior to attachment. Similar approaches may be used for the wear pads of the embodiments of FIGS. 3, 5 and 6. In any of these cases, the metallic core of the retaining ring is reused. In any of the above-described embodiments, the existing, prior-art, retainer ring material may be removed in entirety, and replaced with the wear pad of the invention.

While specific embodiments of the invention have been shown and described, it is to be understood that numerous changes and modifications may be made therein without departing from the scope and spirit of the invention as set forth in the appended claims.

What is claimed is:

1. In a retaining ring for use with a chemical mechanical planarization (CMP) apparatus for the polishing of wafers, which CMP apparatus comprises a polishing head having a polishing pad for polishing the wafer, the retaining ring holding a wafer for contact against the polishing head of the CMP apparatus during the polishing process, said retaining ring comprising a main body portion having a bottom portion and an interior annular surface, the improvement comprising:

said retaining ring comprising wear pad means of fibrous material impregnated with a thermosetting resin for contacting against the polishing pad during the polishing process of the wafer secured in the retaining ring.

2. The retaining ring according to claim 1, wherein said wear pad means comprises a wear pad having an annular member secured to said bottom portion of said main body portion; said annular member having a bottom surface for contact against the polishing pad during the polishing process of the wafer secured in the retaining ring.

3. The retaining ring according to claim 2, in combination with a wafer retained therein, said wafer having an outer annular surface; said interior annular surface of said main body portion surrounding, and in abutting contact with, said outer annular surface of said wafer for retaining said wafer therein; said annular member having an interior annular surface spaced from contact with said outer annular surface of said wafer, whereby said main body portion absorbs impact from said wafer during the polishing process thereof against the polishing head, and said wear pad withstands the heat and abrasion from the polishing pad.

4. The retaining ring according to claim 2, wherein said bottom portion of said main body portion is stepped to define a first cutout section in which is mounted said wear pad and a second stepped section; said cutout section originating at the outer annular surface of said main body portion and extending inwardly toward the interior annular surface of said main body portion; said second stepped section defining the interior annular surface against which the outer annular surface of the wafer abuts against for retention.

5. The retaining ring according to claim 4, wherein said bottom surface of said wear pad protrudes beyond the bottom surface of said second stepped section, whereby only the bottom surface of said wear pad contacts against a polishing pad during the polishing of the wafer.

6. The retaining ring according to claim 2, further comprising insulating layer means interposed between said bottom portion of said main body portion and said wear pad, whereby heat generated during the wafer-polishing process is retained in order to provide wafer-polishing at elevated temperatures.

7. The retaining ring according to claim 6, in combination with a wafer retained therein, said wafer having an outer annular surface; said insulating means comprising an annular insulating ring-member having an interior annular surface; said interior annular surface of said insulating ring-member surrounding, and in abutting contact with, said outer annular surface of said wafer for retaining said wafer therein.

8. The retaining ring according to claim 2, in combination with a wafer retained therein, said wafer having an outer annular surface; said wear pad comprising an interior annular surface surrounding, and in abutting contact with, said outer annular surface of said wafer for retaining said wafer therein, whereby said wear pad both absorbs impact from said wafer during the polishing process thereof against the polishing head and also withstands the heat and abrasion from the polishing pad.

9. The retaining ring according to claim 1, wherein said wear pad means is secured to said bottom portion of said main body portion, whereby after said wear pad means is used up, it may be replaced with another similar wear pad means.

10. The retaining ring according to claim 1, wherein said main body portion is made of fibrous material impregnated with a thermosetting resin, at least a portion of said bottom portion thereof of said main body portion constituting said wear pad means.

11. The retaining ring according to claim 10, wherein said bottom portion of said main body portion is stepped and defines an interior annular cutout section; said retaining ring further comprising an inner annular absorption ring member against which a wafer is in abutting contact, said inner annular absorption ring member absorbing impact from the wafer during the polishing process thereof against a polishing head.

12. The retaining ring according to claim 11, wherein said inner annular a sorption ring member has a depth less than the depth of said interior annular cutout, whereby the bottom surface of said absorption ring member does not contact a polishing pad during a wafer-polishing process.

13. The retaining ring according to claim 11, wherein said inner annular absorption ring member is made of thermoplastic material.

14. The retaining ring according to claim 1, wherein said fibrous material of said wear pad means is selected from one of the group comprising:

Cellulose fiber, such as cotton or wood pulp, :ARAMID", rayon, linen, carbon, graphite, polyamide fiber, polymer fiber, lyocell fiber, and engineered fibers.

15. The retaining ring according to claim 1, wherein said thermosetting resin is selected from one of the group comprising:

Phenolic, epoxy, silicone and phenol formaldehyde.

16. The retaining ring according to claim 1, wherein said wear pad means further comprises hard abrasive particle additive for conditioning a polishing pad as said wear pad means contacts the polishing pad during the polishing process.

17. The retaining ring according to claim 16, wherein said abrasive particle additive comprises abrasive particles in size ranging approximately between 10 to 500 microns in diameter.

18. The retaining ring according to claim 1, wherein the density of said wear pad means is in the range of approximately 0.3 to 2.0 g/cm$^3$.

19. The retaining ring according to claim 1, wherein said wear pad means comprises a bottom surface that contacts a polishing pad during wafer-polishing, said bottom surface being a ground surface with a surface finish of 1–25 mm $R_a$.

20. A method of using a retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, said retaining ring comprising a main portion and a replaceable bottom wear pad secured to said main portion for contacting against the polishing pad during the polishing process of the wafer secured in the retaining ring, comprising:

(a) using the bottom wear pad during wafer-polishing in a CMP apparatus; and (b) replacing the wear pad of step (a) with another wear pad when the wear-pad of said step (a) has been used up, whereby the main portion of the retaining ring need not be replaced;

said step (b) comprising replacing the bottom wear pad with a wear pad comprised of fibrous material impregnated with a thermosetting resin.

21. The retaining ring according to claim 20, wherein said step (b) comprises inserting insulating layer means between said main portion and said wear pad, whereby heat generated during the wafer-polishing process is retained in order to provide wafer-polishing at elevated temperatures.

22. In a retaining ring for increasing the heat produced during wafer-polishing in a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, the retaining ring comprising a main portion and a bottom contact section for contacting against the polishing pad during the polishing process of the wafer secured in the retaining ring, the improvement comprising:

said retaining ring further comprising insulating material layer between said main portion and said bottom contact section, whereby heat generated during the wafer-polishing process is retained by the insulating material layer in order to provide wafer-polishing at elevated temperatures said bottom contact section comprising a replaceable wear pad secured to said insulating material layer, said wear pad being comprised of fibrous material impregnated with a thermosetting resin.

23. A method of prolonging the useful life of a retaining ring used in a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, said retaining ring having a main portion having a bottom surface, comprising:

securing a replaceable wear pad to said bottom surface of said main portion of the retaining ring, and further comprising securing an insulating layer between said bottom surface of said main portion of the retaining ring and said replaceable wear pad.

24. The method according to claim 23, wherein said step of securing a replaceable wear pad comprises attaching a wear pad made of fibrous material impregnated with a thermosetting resin.

25. A retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, comprising:

a main body portion, said main body portion having a bottom portion for contact against a polishing pad during wafer-polishing, and also having an interior annular surface for holding a wafer to be polished;

said bottom portion of said main body portion having hard abrasive particle additive in the material thereof from which said bottom portion is made for conditioning a polishing pad as said bottom portion pad contacts the polishing pad during the polishing process;

said bottom portion of said main body portion comprising a wear pad comprised of fibrous material impregnated with a thermosetting resin.

26. The retaining ring according to claim 25, wherein said abrasive particle additive comprises abrasive particles in size ranging approximately between 10 to 500 microns in diameter.

27. A retaining ring for use with a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, comprising;

a main body portion, said main body portion having a bottom portion comprising a bottom surface, said bottom surface contacting against a polishing pad during wafer-polishing;

said bottom surface of bottom portion of said main body portion having a roughened surface by which the rate of polishing of a wafer held by said main body portion by means of a polishing pad in contact therewith is enhanced;

said bottom portion of said main body portion being a wear pad comprised of fibrous material impregnated with a thermosetting resin.

28. The retaining ring according to claim 27, wherein said bottom portion of said main body portion comprises a replaceable wear pad.

29. The retaining ring according to claim 27, wherein said bottom surface is ground with a surface finish of 1–25 mm $R_a$.

30. A wear pad for use in a chemical mechanical planarization (CMP) apparatus for the polishing of wafers, which CMP apparatus comprises a polishing pad for polishing the wafer, which wafer is retained by retaining means to hold the wafer for contact against the polishing pad of the CMP apparatus during the polishing process, comprising:

an annular member having a bottom section and an upper section; said upper section defining an upper surface, and said bottom section defining a bottom surface;

said bottom surface capable of contact against a polishing pad of a CMP apparatus during the polishing process of a wafer;

at least said bottom section of said annular member being made of fibrous material impregnated with a thermosetting resin.

31. The wear pad according to claim 30, wherein said fibrous material is selected from one of the group comprising:

Cellulose fiber, such as cotton or wood pulp, "ARAMID", rayon, linen, carbon, graphite, polyamide fiber, polymer fiber, lyocell fiber, and engineered fibers.

32. The wear pad according to claim 30, wherein said thermosetting resin is selected from one of the group comprising:

Phenolic, epoxy, silicone and phenol formaldehyde.

33. The wear pad according to claim 30, wherein said annular member further comprises hard abrasive particle additive for conditioning a polishing pad as the wear pad contacts the polishing pad during the polishing process.

34. The wear pad according to claim 30, wherein said abrasive particle additive comprises abrasive particles in size ranging approximately between 10 to 500 microns in diameter.

35. The wear pad according to claim 30, wherein said upper surface is capable of being affixed to the bottom surface of a retaining ring of a CMP apparatus.

36. The wear pad according to claim 30, wherein said upper section is also made of said fibrous material impregnated with a thermosetting resin, whereby the entire said annular member is made said fibrous material impregnated with a thermosetting resin.

37. The wear pad according to claim 36, wherein said annular member also serves as a retaining ring for holding a wafer therein during a wafer-polishing process; and wherein said bottom section of said annular member is stepped and defines an interior annular cutout section; said wear pad further comprising an inner annular absorption ring member against which a wafer may abut and be retained, said inner annular absorption ring member absorbing impact from the wafer during the polishing process thereof against a polishing head.

38. The wear pad according to claim 37, wherein said inner annular absorption ring member has a depth less than the depth of said interior annular cutout, and comprises a bottom surface, whereby said bottom surface of said absorption ring member does not contact a polishing pad during a wafer-polishing process.

39. The retaining ring according to claim 37, wherein said inner annular absorption ring member is made of thermoplastic material.

40. A method of prolonging the useful life of a retaining ring used in a chemical mechanical planarization (CMP) apparatus for the polishing of wafers, which CMP apparatus comprises a polishing pad for polishing the wafer, the retaining ring holding a wafer for contact against the polishing pad of the CMP apparatus during the polishing process, said retaining ring having a main portion having a bottom surface, comprising:

securing a replaceable wear pad to said bottom surface of said main portion of the retaining ring;

said step of securing a replaceable wear pad comprising attaching a wear pad made of fibrous material impregnated with a thermosetting resin.

* * * * *